US009328640B2

(12) United States Patent
Iverson et al.

(10) Patent No.: US 9,328,640 B2
(45) Date of Patent: May 3, 2016

(54) EMISSION ABATEMENT ASSEMBLY HAVING A MIXING BAFFLE AND ASSOCIATED METHOD

(71) Applicant: Faurecia Emissions Control Technologies, USA, LLC, Columbus, IN (US)

(72) Inventors: Robert J. Iverson, Nashville, IN (US); John B. Abel, Freetown, IN (US); Navin Khadiya, Columbus, IN (US); John P. Nohl, Indianapolis, IN (US); Geoff Morgan, Hambleton (GB); Wilbur H. Crawley, Columbus, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 0 days.

(21) Appl. No.: 14/307,770

(22) Filed: Jun. 18, 2014

(65) Prior Publication Data

US 2014/0298774 A1 Oct. 9, 2014

Related U.S. Application Data

(63) Continuation of application No. 11/762,461, filed on Jun. 13, 2007, now Pat. No. 8,789,363.

(51) Int. Cl.
*F01N 3/00* (2006.01)
*F01N 3/025* (2006.01)

(52) U.S. Cl.
CPC ..... *F01N 3/025* (2013.01); *F01N 2240/14* (2013.01); *F01N 2240/20* (2013.01)

(58) Field of Classification Search
CPC ..... F01N 2240/14; F01N 2240/20
See application file for complete search history.

(56) References Cited

U.S. PATENT DOCUMENTS

| | | | | |
|---|---|---|---|---|
| 560,685 | A | | 5/1896 | Cabell |
| 3,738,816 | A | * | 6/1973 | Hirt ..... 422/176 |
| 3,749,130 | A | * | 7/1973 | Howitt et al. ..... 138/42 |
| 3,864,072 | A | | 2/1975 | Abernathy et al. |
| 3,955,538 | A | | 5/1976 | Noguchi et al. |
| 3,993,449 | A | | 11/1976 | Childs |
| 4,036,180 | A | | 7/1977 | Noguchi et al. |
| 4,066,043 | A | | 1/1978 | Noguchi et al. |
| 4,334,855 | A | | 6/1982 | Nelson |
| 4,335,574 | A | | 6/1982 | Sato et al. |

(Continued)

FOREIGN PATENT DOCUMENTS

| | | |
|---|---|---|
| DE | 24 19 126 A1 | 10/1975 |
| DE | 25 35 002 A1 | 2/1977 |

(Continued)

OTHER PUBLICATIONS

PCT Search Report for PCT Application No. PCT/US05/00939, Dec. 2, 2005, 14 pgs.

(Continued)

*Primary Examiner* — Jesse Bogue
(74) *Attorney, Agent, or Firm* — Carlson, Gaskey & Olds, PC

(57) ABSTRACT

An emission abatement assembly includes a fuel-fired burner having a combustion chamber and a particulate filter positioned downstream of the fuel-fired burner. A mixing baffle is positioned between the fuel-fired burner and the particulate filter.

22 Claims, 5 Drawing Sheets

(56) References Cited

U.S. PATENT DOCUMENTS

| | | | | | |
|---|---|---|---|---|---|
| 4,349,330 | A | | 9/1982 | Obinata et al. | |
| 4,362,500 | A | | 12/1982 | Eriksson et al. | |
| 4,404,795 | A | | 9/1983 | Oishi et al. | |
| 4,449,362 | A | | 5/1984 | Frankenberg et al. | |
| 4,477,245 | A | | 10/1984 | Giachino et al. | |
| 4,557,108 | A | | 12/1985 | Torimoto | |
| 4,561,524 | A | | 12/1985 | Mizumukai et al. | |
| 4,571,938 | A | | 2/1986 | Sakurai | |
| 4,574,589 | A | | 3/1986 | Hasegawa et al. | |
| 4,589,254 | A | | 5/1986 | Kume et al. | |
| 4,603,550 | A | | 8/1986 | Shinzawa | |
| 4,622,811 | A | | 11/1986 | Distel et al. | |
| 4,677,823 | A | | 7/1987 | Hardy | |
| 4,912,920 | A | * | 4/1990 | Hirabayashi | 60/303 |
| 4,953,354 | A | | 9/1990 | Erber et al. | |
| 4,983,362 | A | | 1/1991 | Obermuller | |
| 4,987,738 | A | | 1/1991 | Lopez-Crevillen et al. | |
| 5,001,899 | A | | 3/1991 | Santiago et al. | |
| 5,003,778 | A | | 4/1991 | Erber et al. | |
| 5,041,268 | A | | 8/1991 | Inovius | |
| 5,044,158 | A | | 9/1991 | Goerlich | |
| 5,063,736 | A | | 11/1991 | Hough et al. | |
| 5,065,576 | A | * | 11/1991 | Kanazawa et al. | 60/295 |
| 5,079,917 | A | | 1/1992 | Henkel | |
| 5,085,049 | A | | 2/1992 | Rim et al. | |
| 5,140,814 | A | | 8/1992 | Kreutmair et al. | |
| 5,189,392 | A | | 2/1993 | Kass et al. | |
| 5,207,185 | A | | 5/1993 | Greiner et al. | |
| 5,211,009 | A | | 5/1993 | Houben et al. | |
| 5,339,630 | A | | 8/1994 | Pettit | |
| 5,417,059 | A | | 5/1995 | Hartel et al. | |
| 5,458,664 | A | | 10/1995 | Ishii et al. | |
| 5,522,326 | A | | 6/1996 | Vollhardt | |
| 5,605,453 | A | * | 2/1997 | Kenner et al. | 431/262 |
| 5,771,683 | A | | 6/1998 | Webb | |
| 5,807,098 | A | | 9/1998 | Deng | |
| 5,826,428 | A | * | 10/1998 | Blaschke | 60/303 |
| 5,865,618 | A | | 2/1999 | Hiebert | |
| 5,910,097 | A | | 6/1999 | Boegner et al. | |
| 5,919,035 | A | | 7/1999 | Iwama et al. | |
| 5,974,791 | A | | 11/1999 | Hirota et al. | |
| 6,090,187 | A | | 7/2000 | Kumagai | |
| 6,105,365 | A | | 8/2000 | Deeba et al. | |
| 6,170,259 | B1 | | 1/2001 | Boegner et al. | |
| 6,176,078 | B1 | | 1/2001 | Balko et al. | |
| 6,397,587 | B1 | | 6/2002 | van Nieuwstadt et al. | |
| 6,422,006 | B2 | | 7/2002 | Ohmori et al. | |
| 6,446,430 | B1 | | 9/2002 | Roth et al. | |
| 6,464,744 | B2 | | 10/2002 | Cutler et al. | |
| 6,471,918 | B1 | | 10/2002 | Sherwood | |
| 6,634,170 | B2 | | 10/2003 | Hiranuma et al. | |
| 6,679,051 | B1 | | 1/2004 | van Nieustadt et al. | |
| 6,729,128 | B2 | | 5/2004 | Shiratani et al. | |
| 6,783,882 | B2 | | 8/2004 | Schmidt | |
| 6,887,294 | B2 | * | 5/2005 | Kanematsu | 55/418 |
| 6,901,751 | B2 | | 6/2005 | Bunting et al. | |
| 7,032,376 | B1 | | 4/2006 | Webb et al. | |
| 7,451,594 | B2 | * | 11/2008 | Blaisdell | 60/324 |
| 8,397,557 | B2 | * | 3/2013 | Parrish et al. | 73/114.41 |
| 8,539,761 | B2 | * | 9/2013 | Lebas et al. | 60/324 |
| 2003/0066287 | A1 | | 4/2003 | Hirota et al. | |
| 2003/0074893 | A1 | | 4/2003 | Webb et al. | |
| 2003/0091950 | A1 | | 5/2003 | Pijper | |
| 2003/0188518 | A1 | | 10/2003 | Itoyama et al. | |
| 2004/0006977 | A1 | | 1/2004 | Nakatani et al. | |
| 2004/0173005 | A1 | | 9/2004 | Martone et al. | |
| 2005/0150211 | A1 | | 7/2005 | Crawley et al. | |
| 2005/0150217 | A1 | * | 7/2005 | Crawley et al. | 60/295 |
| 2005/0153252 | A1 | | 7/2005 | Crawley | |
| 2006/0218902 | A1 | | 10/2006 | Arellano | |
| 2007/0274877 | A1 | * | 11/2007 | Bush et al. | 422/176 |
| 2008/0087013 | A1 | | 4/2008 | Crawley et al. | |
| 2009/0000287 | A1 | * | 1/2009 | Blaisdell et al. | 60/324 |
| 2010/0199645 | A1 | * | 8/2010 | Telford | 60/295 |
| 2010/0319329 | A1 | * | 12/2010 | Khadiya | 60/295 |

FOREIGN PATENT DOCUMENTS

| | | | |
|---|---|---|---|
| DE | 31 25 305 | A1 | 1/1983 |
| DE | 35 32 777 | A1 | 3/1987 |
| DE | 35 32 779 | A1 | 3/1987 |
| DE | 36 14 812 | A1 | 11/1987 |
| DE | 36 36 787 | A1 | 5/1988 |
| DE | 37 40 047 | A1 | 6/1989 |
| DE | 38 44 554 | A1 | 9/1989 |
| DE | 38 30 687 | A1 | 3/1990 |
| DE | 4012411 | | 10/1991 |
| DE | 42 09 470 | A1 | 4/1993 |
| DE | 196 04 318 | A1 | 8/1997 |
| EP | 0 027 549 | A1 | 4/1981 |
| EP | 0 212 230 | A2 | 3/1987 |
| EP | 0 218 047 | B1 | 4/1987 |
| EP | 0 268 026 | B1 | 5/1988 |
| EP | 0 470 361 | A1 | 12/1989 |
| EP | 0 503 263 | B1 | 9/1992 |
| EP | 0 505 696 | A2 | 9/1992 |
| EP | 0 520 170 | A1 | 12/1992 |
| WO | 91/04394 | A2 | 4/1991 |
| WO | 20050700175 | A2 | 8/2005 |
| WO | 2006138174 | A2 | 12/2006 |

OTHER PUBLICATIONS

"Nox Emission Control for Light-duty CIDI Vehicles," Department of Energy (Apr. 2001).

* cited by examiner

EMISSION ABATEMENT ASSEMBLY HAVING A MIXING BAFFLE AND ASSOCIATED METHOD

RELATED APPLICATION

This application is a continuation of U.S. patent application Ser. No. 11/762,461, filed Jun. 13, 2007.

TECHNICAL FIELD

The present disclosure relates generally to diesel emission abatement devices.

BACKGROUND

Untreated internal combustion engine emissions (e.g., diesel emissions) include various effluents such as NOx, hydrocarbons, and carbon monoxide, for example.

Moreover, the untreated emissions from certain types of internal combustion engines, such as diesel engines, also include particulate carbon-based matter or "soot." Federal regulations relating to soot emission standards are becoming more and more rigid thereby furthering the need for devices and/or methods which remove soot from engine emissions.

The amount of soot released by an engine system can be reduced by the use of an emission abatement device such as a filter or trap. Such a filter or trap is periodically regenerated in order to remove the soot therefrom. The filter or trap may be regenerated by use of a fuel-fired burner to burn the soot trapped in the filter. In such a case, the fuel-fired burner generates heat which is transferred to the downstream filter to burn the soot trapped in the filter. Poor temperature distribution of the generated heat can cause some regions of the filter to be hotter than desired, and other regions to be colder than desired. In the regions that are hotter than desired, the filter can potentially be damaged, whereas the colder regions may not be regenerated.

SUMMARY

According to one aspect of the disclosure, an emission abatement assembly includes a fuel-fired burner having a combustion chamber and a particulate filter positioned downstream of the fuel-fired burner. A mixing baffle is positioned between the fuel-fired burner and the particulate filter.

According to another aspect of the disclosure, an emission abatement assembly includes a particulate filter and a fuel-fired burner positioned upstream of the particulate filter. The fuel-fired burner includes a housing having an exhaust gas inlet port. The fuel-fired burner also includes a combustion chamber having a shroud secured thereto. The combustion chamber and the shroud cooperate to separate a flow of exhaust gas entering the housing through the exhaust gas inlet port into a combustion flow which is advanced through the combustion chamber of the fuel-fired burner, and a bypass flow which is bypassed around the combustion chamber of the fuel-fired burner. The fuel-fired burner also includes a mixing baffle positioned downstream of the combustion chamber and upstream of the particulate filter. The mixing baffle is configured to mix the combustion flow and the bypass flow.

According to yet another aspect of the disclosure, an emission abatement assembly includes a fuel-fired burner having a combustion chamber and a particulate filter positioned downstream of the fuel-fired burner. The assembly also includes a mixing baffle having a collector plate with a hole defined therein, a perforated ring secured to the collector plate, and a diverter plate secured to the perforated ring. The mixing plate is positioned between the fuel-fired burner and the particulate filter such that both a flow of exhaust gas advancing through the combustion chamber and a flow of exhaust gas bypassing the combustion chamber are advanced through the hole in the collector plate.

According to yet another aspect of the disclosure, a method of operating a fuel-fired burner of an emission abatement assembly includes advancing a flow of exhaust gas into a housing of the fuel-fired burner. The method also includes separating the flow of exhaust gas into a combustion flow which is advanced through a combustion chamber of the fuel-fired burner, and a bypass flow which is bypassed around the combustion chamber of the fuel-fired burner. The method also includes directing the combustion flow and the bypass flow radially outwardly with a flow mixer located downstream of the combustion chamber.

These and other features may be best understood from the following drawings and specification.

DETAILED DESCRIPTION

Figure 1:
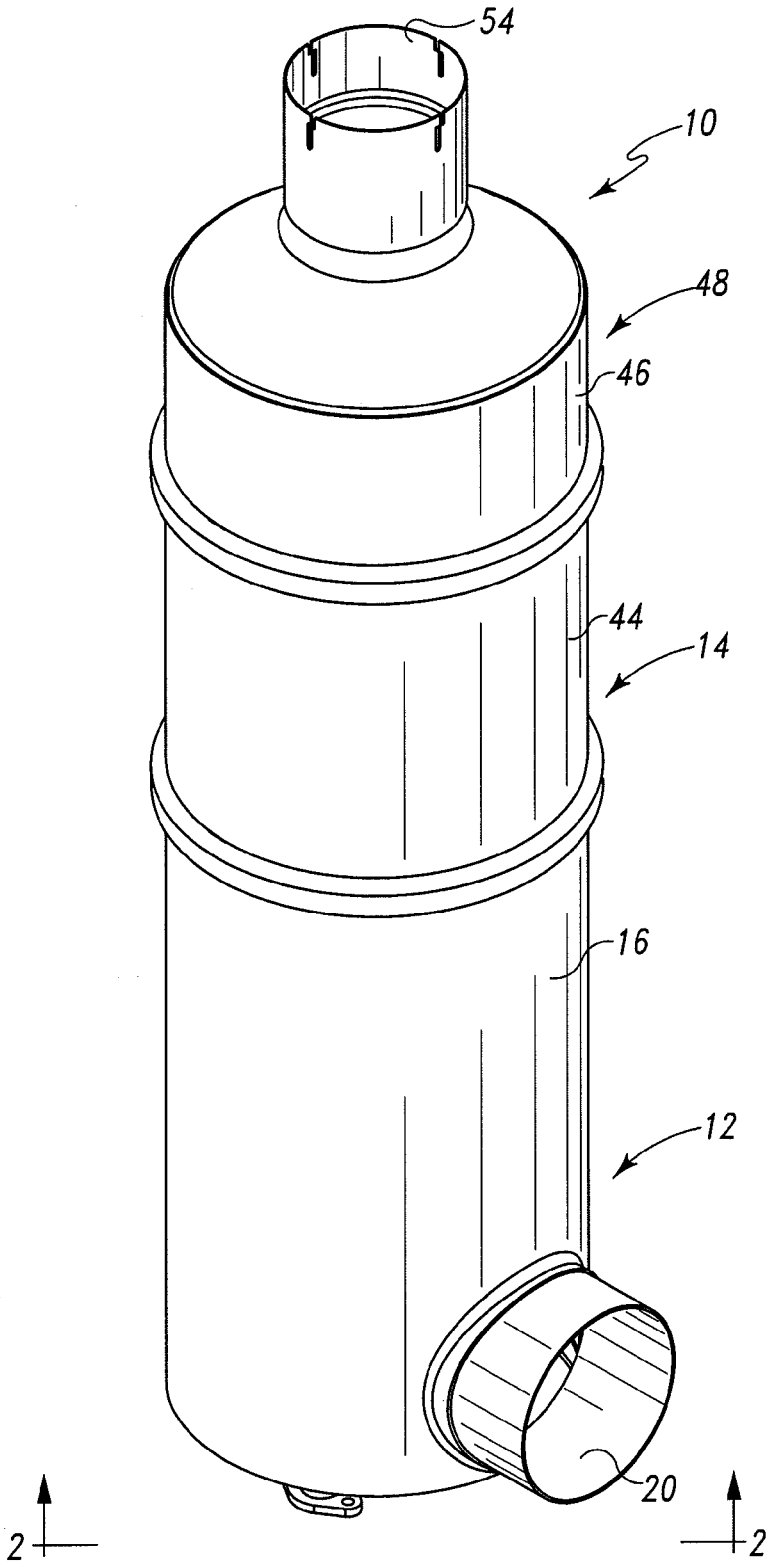
FIG. 1 is a perspective view of an emission abatement assembly.
Figure 2:
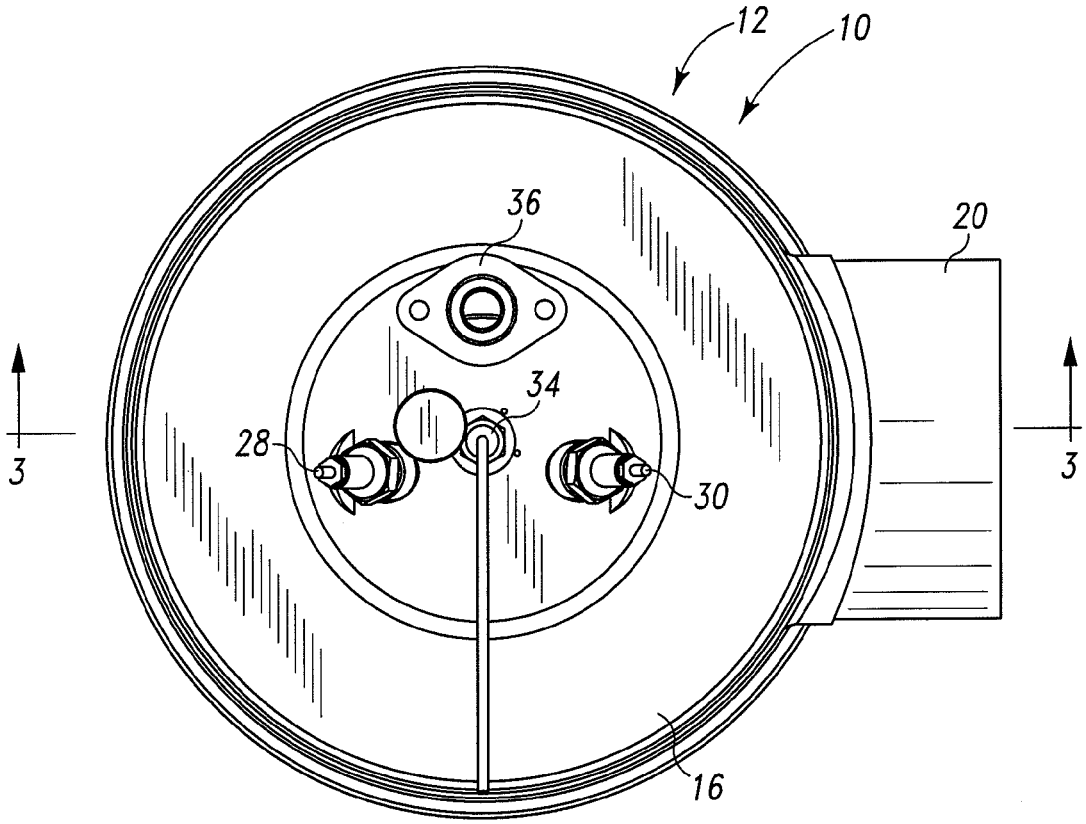
FIG. 2 is an elevational view of the end of the emission abatement assembly as viewed in the direction of the arrows of line 2-2 of FIG. 1.

Referring now to FIG. 1, an emission abatement assembly 10 has a fuel-fired burner 12 and a particulate filter 14. The fuel-fired burner 12 is positioned upstream (relative to exhaust gas flow from the engine) of the particulate filter 14. During operation of the engine, exhaust gas flows through the particulate filter 14 thereby trapping soot in the filter. Treated exhaust gas is released into the atmosphere through an exhaust pipe coupled to the outlet of the emission abatement. From time to time during operation of the engine, the fuel-fired burner 12 is operated to regenerate the particulate filter 14.

Figure 3:
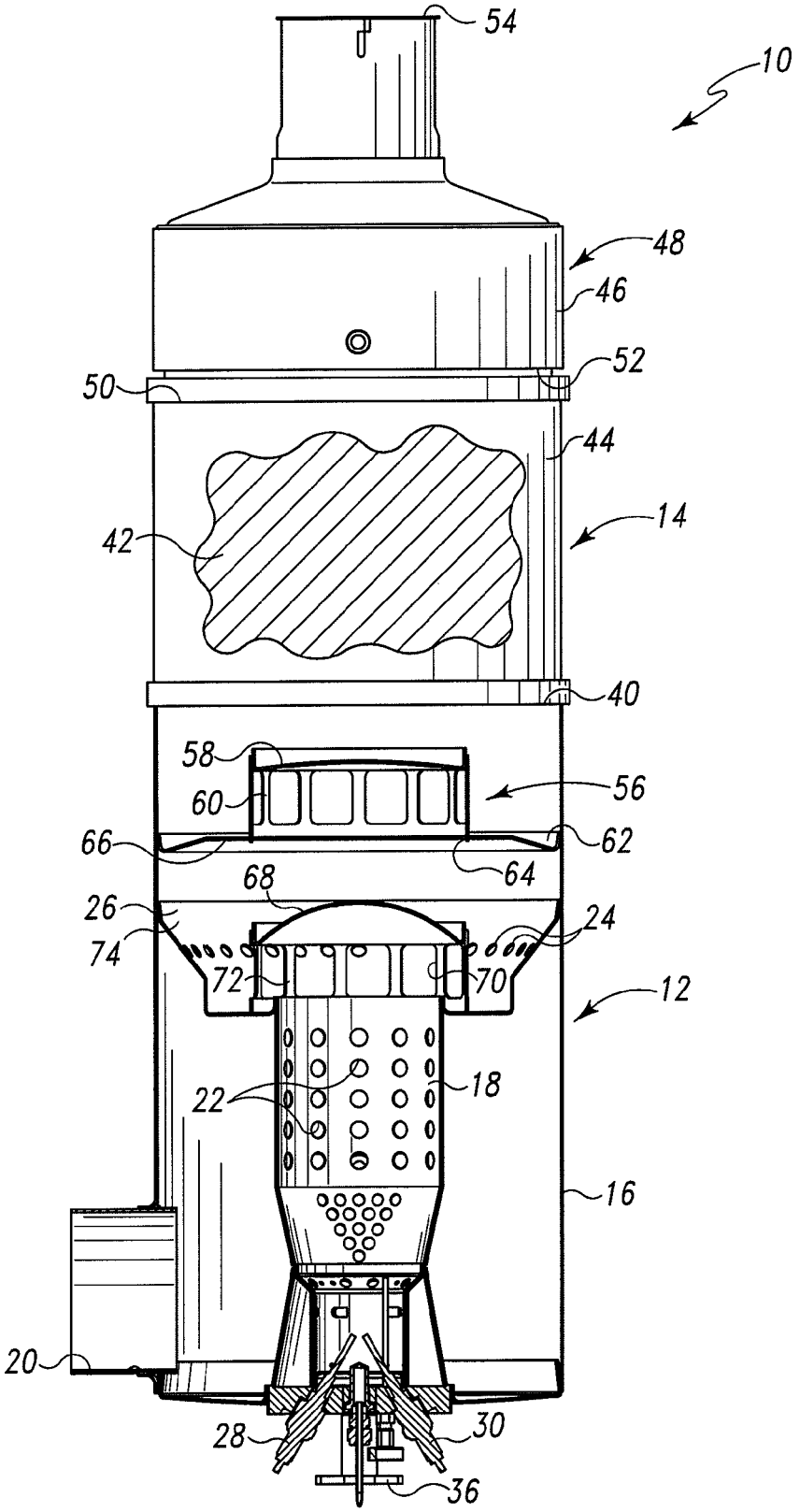
FIG. 3 is a cross sectional view of the emission abatement assembly of FIG. 1 taken along the line 3-3 of FIG. 2, as viewed in the direction of the arrows, note that the filter housing and the collector housing are not shown in cross-section for clarity of description.
Figure 4:
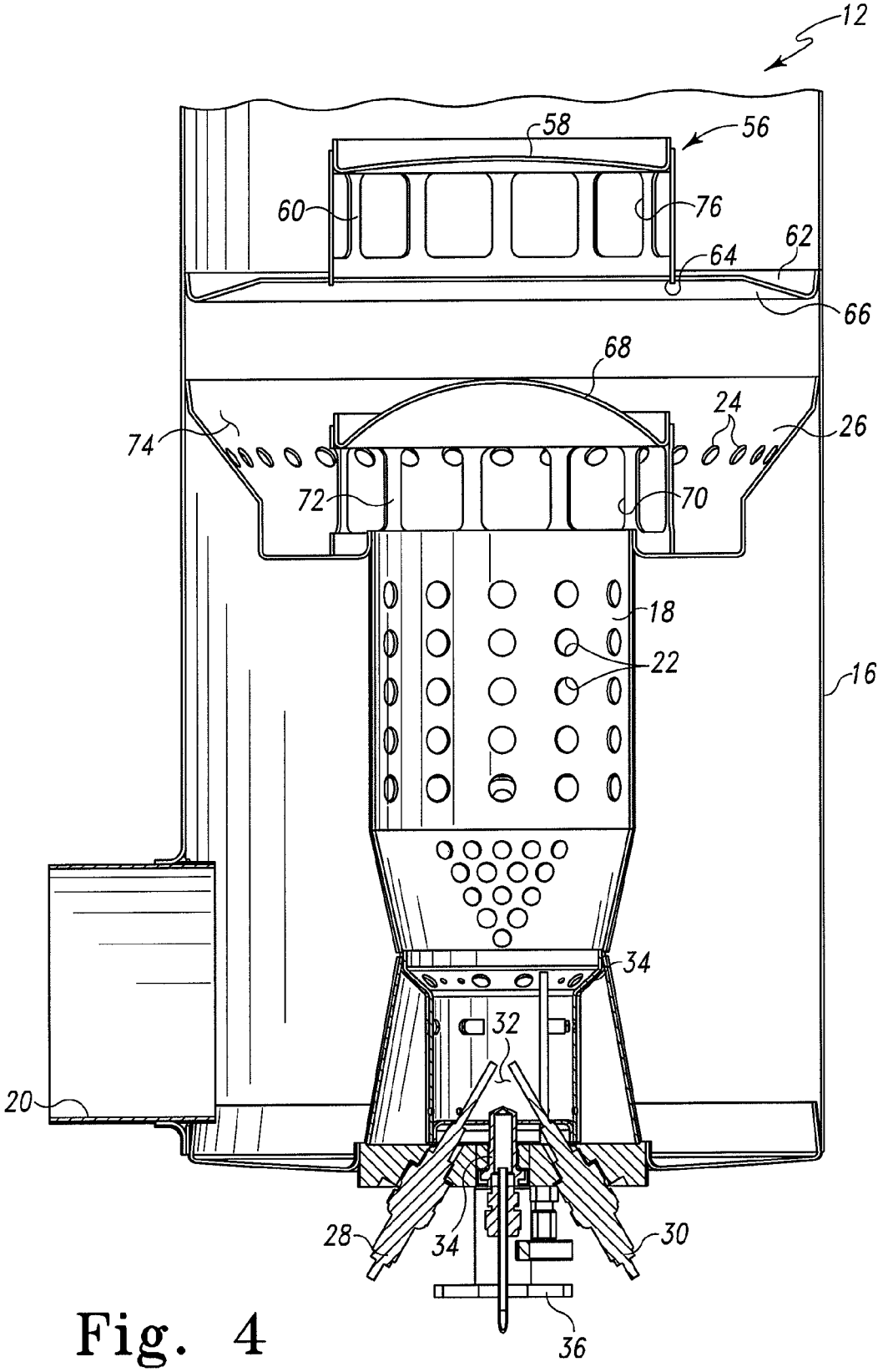
FIG. 4 is an enlarged cross sectional view of the fuel-fired burner of the emission abatement assembly of FIG. 3.

As shown in FIGS. 3 and 4, the fuel-fired burner 12 includes a housing 16 having a combustion chamber 18 positioned therein. The housing 16 includes an exhaust gas inlet port 20. As shown in FIG. 1, the exhaust gas inlet port 20 is secured an exhaust pipe (not shown) which conducts exhaust gas from a diesel engine (not shown). As such, exhaust gas from the diesel engine enters the emission abatement assembly 10 through the exhaust gas inlet port 20.

The combustion chamber 18 has a number of gas inlet openings 22 defined therein. Engine exhaust gas is permitted to flow into the combustion chamber 18 through the inlet openings 22. In such a way, a flame present inside the combustion chamber 18 is protected from the full engine exhaust gas flow, while controlled amounts of engine exhaust gas are permitted to enter the combustion chamber 18 to provide oxygen to facilitate combustion of the fuel supplied to the burner 12. Exhaust gas not entering the combustion chamber 18 is directed through a number of openings 24 defined in a shroud 26.

The fuel-fired burner 12 includes an electrode assembly having a pair of electrodes 28, 30. When power is applied to the electrodes 28, 30, a spark is generated in the gap 32 between the electrodes 28, 30. Fuel enters the fuel-fired burner 12 through a fuel inlet nozzle 34 and is advanced through the gap 32 between the electrodes 28, 30 thereby causing the fuel to be ignited by the spark generated by the electrodes 28, 30. It should be appreciated that the fuel entering the nozzle 34 is generally in the form of a controlled air/fuel mixture.

The fuel-fired burner 12 also includes a combustion air inlet 36. An air pump, or other pressurized air source such as the vehicle's turbocharger or air brake system, generates a flow of pressurized air which is advanced to the combustion air inlet 36. During regeneration of the particulate filter 14, a flow of air is introduced into the fuel-fired burner 12 through the combustion air inlet 36 to provide oxygen (in addition to oxygen present in the exhaust gas) to sustain combustion of the fuel.

As shown in FIG. 3, the particulate filter 14 is positioned downstream from the outlet 40 of the housing 16 of the fuel-fired burner 12 (relative to exhaust gas flow). The particulate filter 14 includes a filter substrate 42. As shown in FIG. 3, the substrate 42 is positioned in a housing 44. The filter housing 44 is secured to the burner housing 16. As such, gas exiting the burner housing 16 is directed into the filter housing 44 and through the substrate 42. The particulate filter 14 may be any type of commercially available particulate filter. For example, the particulate filter 14 may be embodied as any known exhaust particulate filter such as a "deep bed" or "wall flow" filter. Deep bed filters may be embodied as metallic mesh filters, metallic or ceramic foam filters, ceramic fiber mesh filters, and the like. Wall flow filters, on the other hand, may be embodied as a cordierite or silicon carbide ceramic filter with alternating channels plugged at the front and rear of the filter thereby forcing the gas advancing therethrough into one channel, through the walls, and out another channel. Moreover, the filter substrate 42 may be impregnated with a catalytic material such as, for example, a precious metal catalytic material. The catalytic material may be, for example, embodied as platinum, rhodium, palladium, including combinations thereof, along with any other similar catalytic materials. Use of a catalytic material lowers the temperature needed to ignite trapped soot particles.

The filter housing 44 is secured to a housing 46 of a collector 48. Specifically, an outlet 50 of the filter housing 44 is secured to an inlet 52 of the collector housing 46. As such, processed (i.e., filtered) exhaust gas exiting the filter substrate 42 (and hence the filter housing 44) is advanced into the collector 48. The processed exhaust gas is then advanced into the exhaust pipe (not shown) and hence released to the atmosphere through a gas outlet 54. It should be appreciated that the gas outlet 54 may be coupled to the inlet (or a pipe coupled to the inlet) of a subsequent emission abatement device (not shown) if the engine's exhaust system is equipped with such a device.

Figure 5:
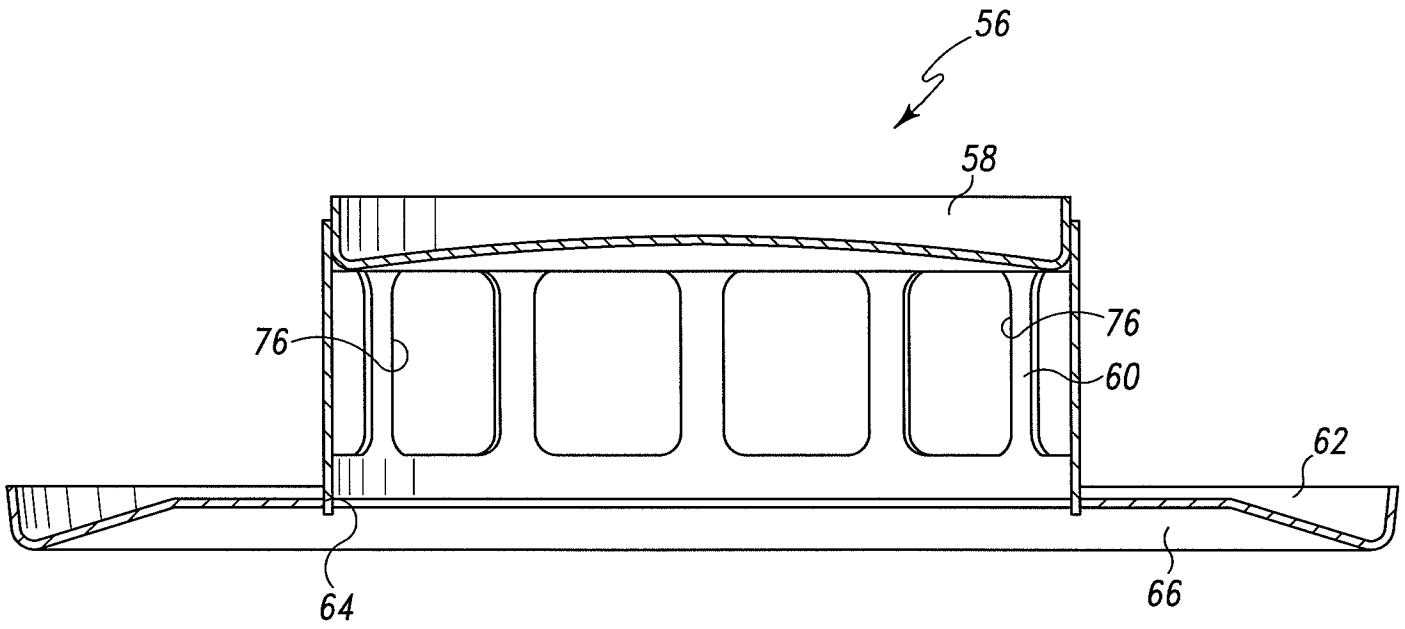
FIG. 5 is an enlarged cross sectional view of the mixing baffle of the fuel-fired burner of FIGS. 1-4.

Referring back to FIGS. 3-5, a mixing baffle 56 is positioned in the burner housing 16. The mixing baffle 56 is positioned between the shroud 26 and the outlet 40 of the burner housing 16. In the illustrative embodiment described herein, the mixing baffle 56 includes a domed diverter plate 58, a perforated annular ring 60, and a collector plate 62. As shown in FIGS. 3 and 4, the collector plate 62 is welded or otherwise secured to the inner surface of the burner housing 16. The collector plate 62 has a hole 64 in the center thereof. The perforated annular ring 60 is welded or otherwise secured to the collector plate 62. The inner diameter of the annular ring 60 is larger than the diameter of the hole 64. As such, the annular ring 60 surrounds the hole 64 of the collector plate 62. The diverter plate 58 is welded or otherwise secured to the end of the annular ring 60 opposite to the end that is secured to the collector plate 62. The diverter plate 58 is solid (i.e., it does not have holes or openings formed therein), and, as such, functions to block the flow of exhaust gas linearly through the mixing baffle 56. Instead, the diverter plate 58 diverts the flow of exhaust gas radially outwardly.

The mixing baffle 56 functions to mix the hot flow of exhaust gas directed through the combustion chamber and cold flow of exhaust gas that bypasses the combustion chamber during filter regeneration thereby introducing a mixed flow of exhaust gas into the particulate filter 14. In particular, as described above, the flow of exhaust gas entering the emission abatement assembly 10 is split into two flows (i) a cold bypass flow which bypasses the combustion chamber 18 and is advanced through the openings 24 of the shroud 26 and, (ii) a hot combustion flow which is advanced into the combustion chamber 18 where it is significantly heated by the flame present therein. The mixer baffle 56 forces both flows together through a narrow area and then causes such a concentrated flow to then flow radially outwardly thereby mixing the two flows together. To do so, the cold flow of exhaust gas advances through the openings 24 in the shroud 26 and thereafter is directed into contact with the upstream face 66 of the collector plate 62. The shape of the collector plate 62 directs the cold flow toward its hole 64.

Likewise, the hot flow of exhaust gas is directed toward the hole of the collector plate 62. In particular, the hot flow of exhaust gas is prevented from axially exiting the combustion chamber 18 by a domed flame catch 68. The flame catch 68 forces the hot flow of exhaust gas radially outwardly through a number of openings 70 defined in a perforated annular ring 72 which is similar to the perforated annular ring 60 of the mixing baffle 56. The hot flow of exhaust gas is then directed toward the upstream face 66 of the collector plate 62 by a combination of surfaces including the downstream face 74 of the shroud 26 and the inner surface of the burner housing 16. The hot flow of exhaust gas then contacts the upstream face 66 of the collector plate where the shape of the plate 62 causes the hot flow of exhaust gas to be directed toward the hole 64. This begins the mixing of the hot flow of exhaust gas with the cold flow of exhaust gas.

Mixing is continued as the cold and hot flows of exhaust gas enter the hole 64 of the collector plate 62. The partially mixed flow of gases are directed into contact with the diverter plate 58. The diverter plate 58 blocks the linear flow of gases and directs them outwardly in radial directions away from the diverter plate 58. The flow of exhaust gases is then directed through a number of openings 76 formed in the perforated annular ring 60 of the mixing baffle 56. This radial outward flow of exhaust gases impinges on the inner surface of the burner housing 16 and is directed through the outlet 40 of the burner housing 16 and into the inlet of the filter housing 44 where the mixed flow of exhaust gas is utilized to regenerated the filter substrate 42.

Hence, as described above, the mixing baffle 56 forces the mixing of the non-homogeneous exhaust gas flow through a narrow area, and then causes the mixed flow to expand outwardly. This prevents the formation of a center flow or center jet of hot gas from being impinged on the filter substrate 42. In short, a more homogeneous mixture of the hot and cold flows is created prior to introduction of the combined flow onto the face of the filter substrate thereby increasing filter regeneration efficiency and reducing the potential for filter damage due to hot spots.

While the disclosure is susceptible to various modifications and alternative forms, specific exemplary embodiments thereof have been shown by way of example in the drawings and has herein be described in detail. It should be understood, however, that there is no intent to limit the disclosure to the particular forms disclosed, but on the contrary, the intention is to cover all modifications, equivalents, and alternatives falling within the spirit and scope of the disclosure.

There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of apparatus, systems, and methods that incorporate one or more of the features of the present disclosure and fall within the spirit and scope of the present disclosure.

For example, the mixing baffle 56 finds application outside of a particulate filter that is regenerated by a fuel-fired burner. For example, the mixing baffle 56 may be used to mix urea with exhaust gas prior to introduction into a urea-SCR catalyst.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. An emission abatement assembly comprising:

a particulate filter, and a fuel-fired burner positioned upstream of the particulate filter, the fuel fired burner comprising:

a housing having an exhaust gas inlet port, a combustion chamber having a shroud secured thereto, the combustion chamber and the shroud cooperate to separate a flow of exhaust gas entering the housing through the exhaust gas inlet port into a combustion flow which is advanced through the combustion chamber of the fuel-fired burner, and a bypass flow which is bypassed around the combustion chamber of the fuel-fired burner, a flame catch associated with the shroud and positioned downstream of the combustion chamber, and a mixing baffle positioned downstream of the flame catch and upstream of the particulate filter, the mixing baffle being configured to mix the combustion flow and the bypass flow, and wherein the mixing baffle includes a collector plate fixed to the housing downstream of the flame catch and a diverter plate fixed to the collector plate, and wherein the combustion flow and bypass flow are directed toward upstream faces of the collector and diverter plates upon exiting the shroud and combustion chamber.

2. The emission abatement assembly of claim 1, wherein the collector plate includes a hole, and wherein the mixing baffle includes a perforated ring having an upstream end fixed to the collector plate to surround the hole and a downstream end fixed to the diverter plate, and wherein the perforated ring includes a plurality of openings such that combustion flow and bypass flow are directed through the hole in the collector plate and are diverted radially outwardly through the openings by the diverter plate.

3. The emission abatement assembly of claim 1, including a perforated ring having an upstream end fixed to the shroud to surround an outlet from the combustion chamber and a downstream end fixed to the flame catch.

4. An emission abatement assembly comprising:

a particulate filter, and a fuel-fired burner positioned upstream of the particulate filter, the fuel fired burner comprising:

a housing having an exhaust gas inlet port, a combustion chamber having a shroud secured thereto, the combustion chamber and the shroud cooperate to separate a flow of exhaust gas entering the housing through the exhaust gas inlet port into a combustion flow which is advanced through the combustion chamber of the fuel-fired burner, and a bypass flow which is bypassed around the combustion chamber of the fuel-fired burner, and wherein the combustion chamber includes a plurality of inlet openings through which a portion of the exhaust gas enters the combustion chamber to provide a hot combustion flow, and wherein the shroud includes a plurality of openings through which a remaining portion of the exhaust gas is bypassed around the combustion chamber to provide a cold bypass flow, and a mixing baffle including a collector plate and diverter plate positioned downstream of the combustion chamber and upstream of the particulate filter, the mixing baffle being configured to mix the combustion flow and the bypass flow, and wherein the mixing baffle includes a perforated annular ring having an upstream end attached to the collector plate and a downstream end attached to the diverter plate such that the hot combustion flow and cold bypass flow are advanced toward the collector plate upon exiting the shroud and the combustion chamber.

5. The emission abatement assembly of claim 4, wherein:

the collector plate has a hole defined therein, and the diverter plate is positioned downstream of the hole.

6. The emission abatement assembly of claim 4, wherein the collector plate includes a central opening that is surrounded by the perforated annular ring, and wherein the hot combustion flow and the cold bypass flow contact an upstream face of the collector plate which then directs the hot combustion flow and the cold bypass flow through the central opening to produce a partially mixed flow that contacts the diverter plate, and wherein the perforated annular ring includes a plurality of perforated openings through which the partially mixed flow is directed radially outwardly to contact an inner surface of the housing of the fuel-fired burner to produce a fully mixed flow that is directed to an outlet of the housing.

7. The emission abatement assembly of claim 6, including a flame catch located upstream of the collector plate and an upstream annular ring positioned within the shroud, and wherein the flame catch directs the hot combustion flow exiting the combustion chamber radially outwardly through a plurality of openings in the upstream annular ring, and wherein the combustion and bypass flows are then directed downstream toward the collector plate.

8. The emission abatement assembly of claim 4, wherein the combustion chamber has an open upstream end associated with a combustion air inlet that receives air from a pressurized air source.

9. The emission abatement assembly of claim 4, wherein the diverter plate is downstream of the collector plate such that the combustion flow exits an opening in the collector plate and is diverted radially outward by the diverter plate such that the combustion flow is directed around an outer peripheral edge of the diverter plate.

10. An emission abatement assembly comprising:

a particulate filter, and a fuel-fired burner positioned upstream of the particulate filter, the fuel fired burner comprising:

a housing having an exhaust gas inlet port, a combustion chamber having a shroud secured thereto, the combustion chamber and the shroud cooperate to separate a flow of exhaust gas entering the housing through the exhaust gas inlet port into a combustion flow which is advanced through the combustion chamber of the fuel-fired burner, and a bypass flow which is bypassed around the combustion chamber of the fuel-fired burner, and a mixing baffle including a collector plate and diverter plate positioned downstream of the combustion chamber and upstream of the particulate filter, the mixing baffle being configured to mix the combustion flow and the bypass flow wherein:

the collector plate has a hole defined therein, the diverter plate is positioned downstream of the hole the mixing baffle further comprises a perforated ring surrounding the hole, a first end of the perforated ring is secured to the collector plate, and a second end of the perforated ring is secured to the diverter plate.

11. The emission abatement assembly of claim 10, wherein the mixing baffle is configured such that the combustion flow and bypass flow are at least partially mixed when said flows are directed radially outwardly through the perforated ring by contact with the diverter plate.

12. The emission abatement assembly of claim 11, wherein the diverter plate is domed.

13. An emission abatement assembly, a fuel-fired burner having a combustion chamber, a particulate filter positioned downstream of the fuel-fired burner, and a mixing baffle comprising a collector plate having a hole defined therein, a perforated ring secured to the collector plate, and a diverter plate secured to the perforated ring, wherein the mixing baffle is positioned between the fuel fired burner and the particulate filter such that both a flow of exhaust gas advancing through the combustion chamber and a flow of exhaust gas bypassing the combustion chamber are advanced through the hole in the collector plate.

14. The emission abatement assembly of claim 13, wherein the perforated ring surrounds the hole of the collector plate.

15. The emission abatement assembly of claim 13, including a shroud secured to the combustion chamber and cooperating with the combustion chamber to separating the exhaust flow into a combustion flow flowing through the combustion chamber and a bypass flow that bypass the combustion chamber, and an annular ring having an upstream end fixed to the shroud to surround an outlet from the combustion chamber and a downstream end fixed to a flame catch, wherein the flame catch directs hot combustion flow exiting the combustion chamber radially outwardly through a plurality of openings in the annular ring to mix with the bypass flow, and wherein the combustion and bypass flows are then directed downstream toward the mixing baffle.

16. The emission abatement assembly of claim 15, wherein the collector plate includes a central opening that is surrounded by the perforated ring, and wherein hot combustion flow and cold bypass flow contact an upstream face of the collector plate which then directs the hot combustion flow and the cold bypass flow through the central opening to produce a partially mixed flow that contacts the diverter plate, and wherein the perforated annular ring includes a plurality of perforated openings through which the partially mixed flow is directed radially outwardly to contact an inner surface of the housing of the fuel-fired burner to produce a fully mixed flow that is directed to an outlet of the housing.

17. A method of operating a fuel-fired burner of an emission abatement assembly, the method comprising the steps of:

advancing a flow of exhaust gas into a housing of the fuel-fired burner, separating the flow of exhaust gas into a combustion flow which is advanced through a combustion chamber of the fuel-fired burner, and a bypass flow which is bypassed around the combustion chamber of the fuel-fired burner, and further including advancing a portion of the exhaust gas through a plurality of inlet openings in the combustion chamber to provide a hot combustion flow, bypassing a remaining portion of the exhaust gas around the combustion chamber and through a plurality of openings formed in a shroud to provide a cold bypass flow, and directing the combustion flow and the bypass flow radially outwardly with a flow mixer located downstream of the combustion chamber, and further including advancing the combustion flow and bypass flow toward the flow mixer, wherein the flow mixer comprises a collector plate attached to the housing of the fuel-fired burner, a perforated annular ring having an upstream end secured to the collector plate, and a diverter plate secured to a downstream end of the perforated annular ring.

18. The method of claim 17, wherein the directing step comprises advancing the combustion flow and the bypass flow through a hole defined in a collector plate.

19. The method of claim 17, wherein the directing step comprises advancing the combustion flow and the bypass flow through a hole defined in a collector plate and into contact with a diverter plate.

20. The method of claim 17, wherein the directing step comprises advancing the combustion flow and the bypass flow through a hole defined in a collector plate, into contact with a diverter plate, and radially outwardly from the diverter plate through a perforated ring.

21. The method of claim 17, including advancing hot combustion flow into contact with a flame catch located upstream of the collector plate, and directing the hot combustion flow radially outwardly through a plurality of openings in an upstream annular ring positioned within the shroud.

22. The method of claim 17, including providing the flow mixer with a diverter plate that is downstream of a collector plate such that the combustion flow exits an opening in the collector plate and is diverted radially outward by the diverter plate such that the combustion flow is directed around an outer peripheral edge of the diverter plate.

* * * * *